United States Patent [19]

Facto

[11] 4,375,844

[45] Mar. 8, 1983

[54] COIN OPERATED MECHANISM WITH ANTI-THEFT LATCH

[76] Inventor: Arthur R. Facto, 17 Lormar Dr., Toronto, Ontario, Canada, M9B 4V7

[21] Appl. No.: 250,291

[22] Filed: Apr. 2, 1981

[51] Int. Cl.[3] ..... G07F 5/06

[52] U.S. Cl. ..... 194/54; 194/97 R

[58] Field of Search ..... 194/54, 59, 65, DIG. 29, 194/97 R, 1 C, 1 D

[56] References Cited

U.S. PATENT DOCUMENTS

| | | | |
|---|---|---|---|
| 2,925,898 | 2/1960 | Terry . | |
| 3,174,608 | 3/1965 | Knickerbocker . | |
| 3,253,690 | 5/1966 | Brewton et al. . | |
| 3,265,177 | 8/1966 | Knickerbocker . | |
| 3,403,765 | 10/1968 | Knickerbocker | 194/54 |
| 3,503,482 | 3/1970 | Davis . | |
| 3,760,923 | 9/1973 | Voegeli . | |
| 3,870,136 | 3/1975 | Voegeli . | |
| 4,175,989 | 11/1979 | Pospischil et al. . | |

*Primary Examiner*—Stanley H. Tollberg
*Attorney, Agent, or Firm*—Donald E. Hewson

[57] ABSTRACT

A coin operated vending mechanism is provided, particularly for use with cabinets in which newspapers and the like may be stored, for sale, upon insertion into appropriate slots of the correct coinage so as to operate the mechanism. Generally, a pair of coin chutes is provided, so as to provide for suitable combinations of coins. An anti-theft mechanism is provided, whereby return of coins in the coin chutes at the same time that the cabinet door is opened, or vice versa, is precluded—i.e., either the coins will return and the door latch will remain locked, or the door latch may be unlatched and no coins will be returned. The anti-theft mechanism comprises a first rotatable plate which engages a latch plate on the door, and a second plate supported by the first plate, such that when the latch plate is moved when the door is to be opened, the second plate swings into a position which precludes movement of the coin chutes in which coins are placed to a coin return position; and when the coin chutes are in a coin return position, un-latching of the latch plate is precluded.

6 Claims, 15 Drawing Figures

COIN OPERATED MECHANISM WITH ANTI-THEFT LATCH

FIELD OF THE INVENTION

This invention relates to coin operated vending mechanisms; and more particularly, to the kind of mechanism associated with cabinets from which various articles such as newspapers or the like may be obtained, upon insertion of the proper amount of coinage into the mechanism so as to release a latched access door. The coin operated vending mechanism of the present invention, may, of course, be applied to many other kinds of coin accessible vending cabinets such as those from which food or snack items, or notions, may be obtained; and moreover, the mechanism may be applicable to such installations as commercial or industrial security which requires the deposit of a token so as to achieve entry into an otherwise restricted area.

BACKGROUND OF THE INVENTION

In particular, however, the present invention is directed to coin operated vending mechanisms for newspapers and the like, because it is that kind of mechanism, more than any other, where a latched door is unlatched by camming action of a coin (or coins) inserted into the mechanism, for access into the cabinet so as to retrieve that which is being vended. However, previous mechanisms have had certain short comings, particularly as discussed hereafter.

Very often, coin operated newspaper vending boxes are owned by independent operators. That is, the owners purchase their stock of newspapers from the newspaper publishers at a price less than retail, and re-sell the newspapers to the general public, at retail price. In most instances, when access to the storage cabinet is achieved by successful operation of the coin operated mechanism, more than one newspaper may be taken but such is not a common occurrence. More often, however, it may occur that some persons—most likely vandals—will attempt to operate the mechanism so as to remove from the interior of the cabinet one or more of the newspapers being stored therein, while at the same time having returned to them their coins by which the mechanism was operated in the first instance. It has been found that prior devices can, with some easily developed skill, be manipulated to achieve those ends, by inserting the coins in the power places, and in the proper amount, and then simultaneously operating the coin return mechanism and opening the door to the cabinet.

The present invention goes to preclude such unauthorized and dishonest practice. Thus, cabinets having a coin operated vending mechanism of the present invention are such that return of the coin from the coin chutes within the mechanism at the same time as the access door to the cabinet is opened, may be precluded; and vice versa, that is that the access door cannot be opened at the same time that the coin return mechanism is operated to retrieve coins within the coin chutes.

More particularly, the present invention goes to provide a device and mechanism which is more simply and easy to assemble and services, having fewer parts than the prior devices.

Coin operating vending mechanisms of the sort taught in KNICKERBOCKER U.S. PAT. No. 3,265,17 dated Aug. 9, 1967 and U.S. Pat. No. 3,403,765 dated Oct. 1, 1968, are commonly found in the field.

Those mechanisms are extremely complicated mechanisms which are difficult to service, and are difficult to adjust for differences in operating coinage at such times when the retail prices of the newspapers or other objects being vended may change.

The present invention, on the other hand, provides ease of operation and adjustment for different price changes requiring different coinage, and provides means whereby different combinations of coins can be employed to effect operation of the mechanism. As well, the present invention provides means by which a weekday/weekend price change can be more easily put into effect than in prior devices, simply by altering the position of certain of the internal elements of the mechanism.

SUMMARY OF THE INVENTION

The present invention comprises, therefore, a mechanism which is coin operated so as to open an access door to a cabinet, for purposes of retrieving an object being stored therein, where the mechanism comprises a number of plates, a first of which has at least one slot therein to receive a coin inserted therethrough, with at least one coin chute in communication with the slot. At least one pawl is adapted to engage an edge of a coin when it is placed in the coin chute, and a latch plate is spring biased into co-operating position with a latch hook, and has a camming portion which is operable by co-action between the proper coinage in the coin chute and the pawl when it is arranged in the proper position to engage that coinage so as to release the latch plate from the latch hook. The latch plate is mounted to the access door so as to thereby permit opening thereof, and when the access door is thus opened the coinage in the coin chute falls past the position normally occupied by the latch plate into a coin collecting receptacle within the mechanism. A coin return button is provided in co-operation with the at least one coin chute to move it into a coin return position over a coin return chute, when a coin return operation is desired. An anti-theft mechanism is provided to prevent return of the coinage in the coin chute at the same time as the door is opened, or vice versa, and comprises a first anti-theft plate adapted for rotation about a mounting point therefor, which anti-theft plate engages the latch plate so as to be in a first position such that when the latch plate is moved out of engagement with the anti-theft plate, it swings by gravity into a second position. A counter-balance plate is adapted for rotation about its respective mounting point, and engages the anti-theft plate so as to be in a first position when the anti-theft plate is in its respective first position, such that when the anti-theft plate assumes its second position the counter-balance plate is permitted to swing by gravity to its second position; the second position of the counter-balance plate being such that it physically precludes movement of the coin chute over the coin return chute.

An object of this invention is, therefore, to provide a coin operated vending mechanism which is easily assembled and more easily and economically produced than prior art devices.

A further object of this invention is to provide such a coin operated vending mechanism which has an anti-theft mechanism in it which precludes return of any coins in the coin chutes at the same time as the door is opened; or putting it in the opposite mode, the anti-theft mechanism precludes opening the door at the same time that any attempt is made to retrieve coins within the coin chutes.

BRIEF DESCRIPTION OF THE DRAWINGS

These and other features of the objects of the invention are discussed in greater detail hereafter, in association with the accompanying drawings, in which.

and

Figure 5:
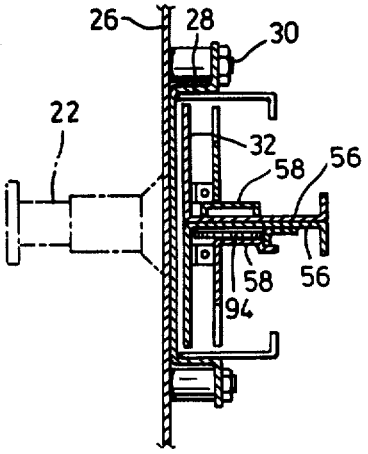
FIG. 5 is a section taken along the arrows 5—5 in FIG. 4.
Figures 6, 7:
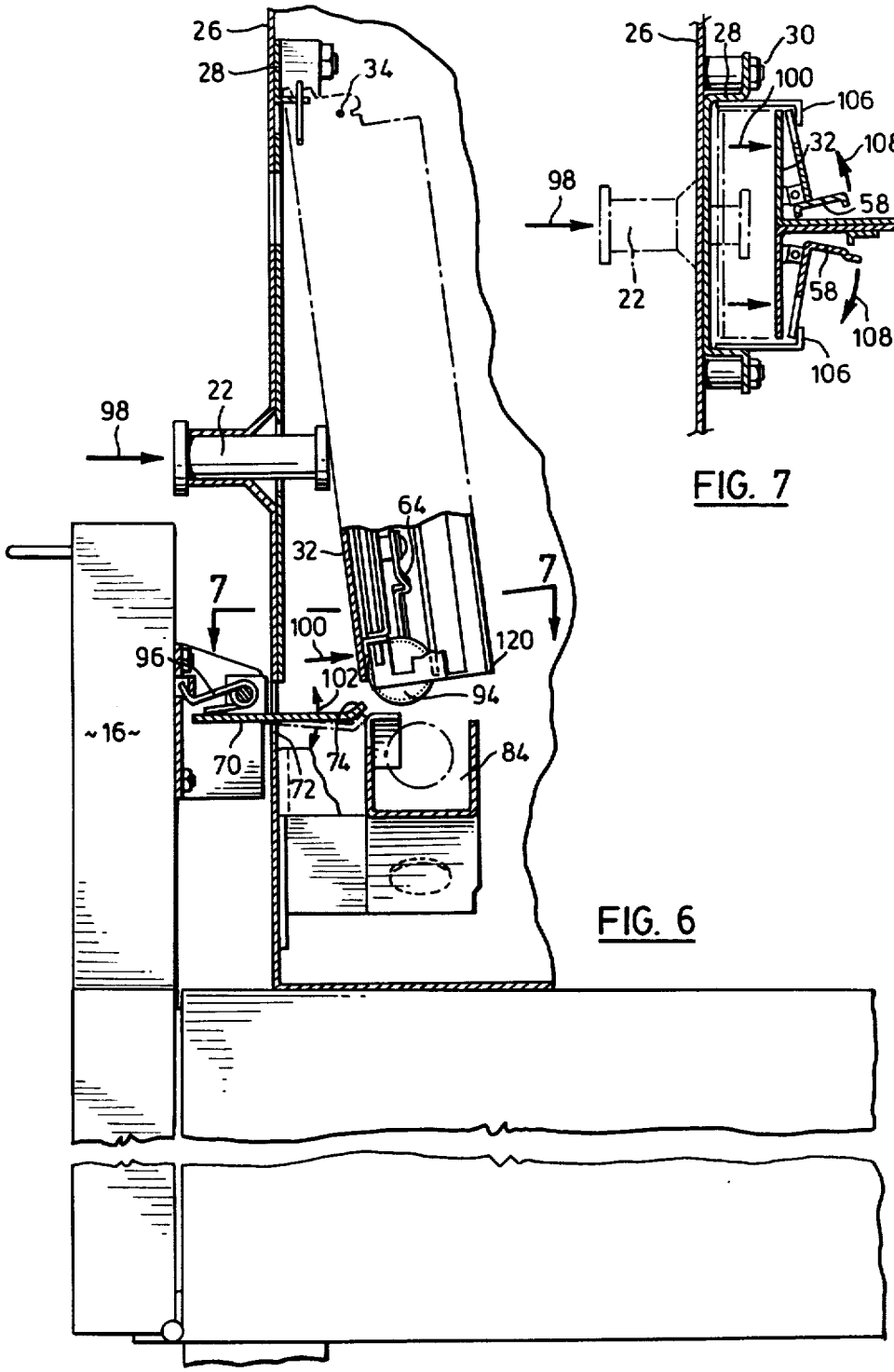
FIG. 6 is a view similar to FIG. 4 but with the coin return button depressed.
FIG. 7 is a view equivalent to FIG. 5, showing the relative position of the parts thereof when in the position shown in FIG. 6, and taken in the direction of arrows 7—7 of FIG. 6.
Figure 14:
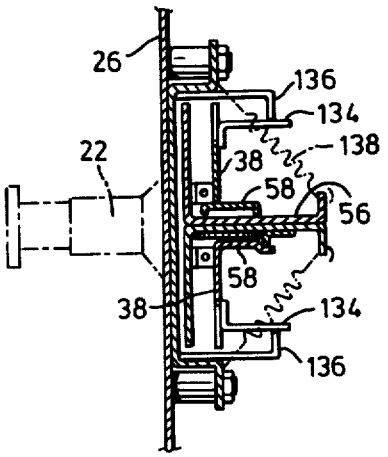
Figure 15:
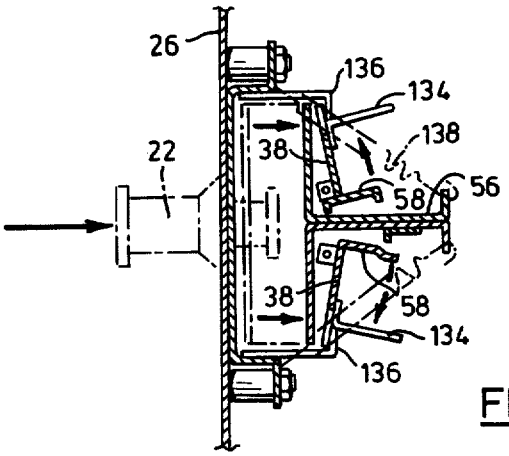

FIGS. 14 and 15 are equivalent to FIGS. 5 and 7 but showing a further embodiment whereby only a single pair of springs is used for spring biasing certain components.

DESCRIPTION OF THE PREFERRED EMBODIMENTS

Figure 1:
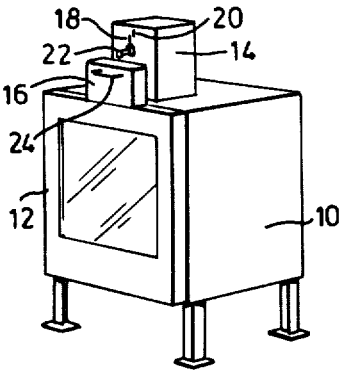
FIG. 1 is a general perspective view of a cabinet having a coin operated vending mechanism secured thereto.

A cabinet 10, having a door 12, is shown in FIG. 1. Mounted on top of the cabinet 10 is a coin operated vending mechanism within an enclosure 14; and a portion of the mechanism is housed within an upper portion 16 of the door 12. Slots 18 and 20 are seen in the housing 14, together with a coin return button 22. A handle 24 is provided for opening the door 12, as discussed hereafter. The cabinet 10 is shown as being of the sort in which newspapers may normally be kept for retail vending to the public, but as noted above the coin operated vending mechanism of the present invention, within its housing 14, may be otherwise placed without departing from the spirit and scope of this invention.

Figure 2:
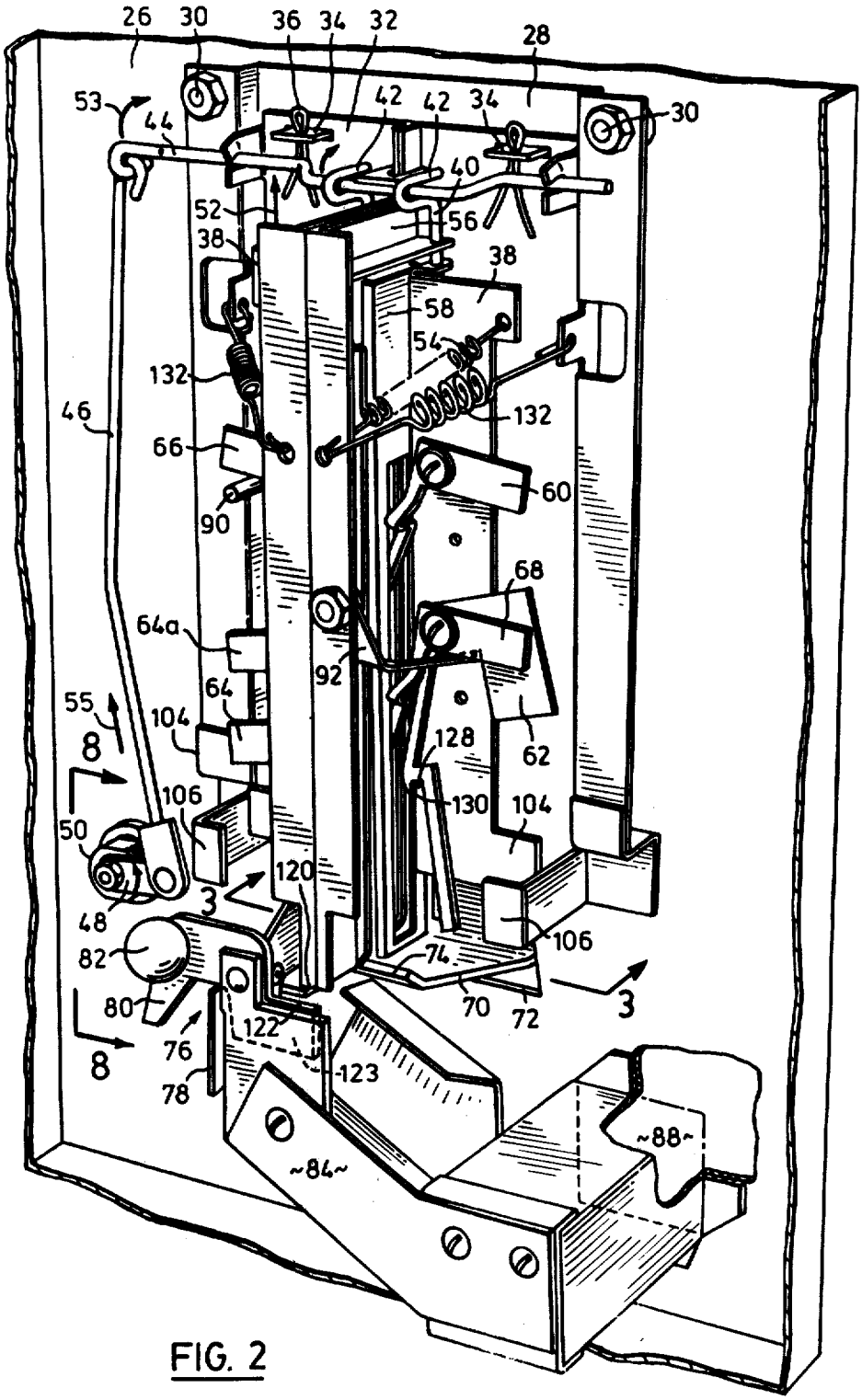
FIG. 2 is a rear perspective view of the principal operating parts of a coin operated vending mechanism according to this invention.

Turning to FIG. 2, the principal features and components of the present invention are shown in detail; and the operation will be discussed hereafter in association with others of the Figures.

A cover plate 26 for the housing 14 is provided. To the cover plate 26 there is mounted a base plate 28, which may be secured in place by suitable fastening means 30. Behind the base plate 28 there is a front plate 32 for the coin operated vending mechanism, secured in position by tangs 34, with split pin 36. As will be noted hereafter, the front plate 32 is essentially hingedly mounted to the base plate 28 and therefore with respect to the cover plate 26, where it is mounted to the tangs 34.

A pawl mounting plate 38 is mounted at each side of the mechanism, and each pawl mounting plate 38 is mounted in such a way as to be rotatable about a rod 40. The upper end 42 of each of the rods 40 is, in turn, secured to a crank rod 44, which is operated from a push rod 46 secured at its lower end to a crank arm 48 of a key cylinder 50. When the crank arm 48 is rotated from its vertical to its horizontal position, or vice verse, by an operating key placed in the front side of the key cylinder, the pawl mounting plates 38 are moved upwards and downwards in the manner shown by arrows 52, thereby effecting a change in the operating mechanism from weekday to weekend operation, or vice versa. Other arrows 53 and 55 are shown in association with the crank arm, push rod and crank rod, to assist understanding of the weekday/weekend or weekend-/weekday operating change which can be effected in the coin operated vending mechanism according to this invention. In the embodiment of FIG. 2, the pawl mounting plate is biased in its closed position by springs 54, as discussed in greater detail hereafter with respect to FIGS. 5 and 7.

In the embodiment shown, as noted, there are two coin chute cover mounting plates 58, one on each side of a pair of web plates 56, each of which is upstanding from the front plate 32, so that a pair of coin chutes is defined between the respective web plates 56 and coin chute plates 58.

Along each side of the mechanism, there may be located a number of pawls, several of which are specifically noted at 60, 62, 64, 64*a*, 66 and 68.

In the lower portion of the mechanism, there is a latch plate 70 which extends through a latch opening 72, and has a coin camming portion 74 at the rear end thereof beneath the coin chutes. Behind the lower portion of the mechanism, there is an anti-theft mechanism generally indicated at 76, the principal components of which are the anti-theft plate 78, and the counter-balance plate 80 to which is secured a counter-balance ball 82, as discussed in greater detail hereafter. A coin return chute 84 is provided, having an opening 88 through the cover plate 26, for access into the lower portion of the coin return chute 84 so as to recover returned coins as discussed in greater detail hereafter.

A stop pin 90 is shown, locking up pawl 66. The stop pin is secured to the base plate 26, and is such that pawl 66 falls into place only when the pawl mounting plate 38 is in its upper position. Likewise, the pawl 62 is shown swung out of position by a stop pawl 92; so that the pawl 62 also becomes operative only when the pawl mounting plate 38 is in its upper position.

Figure 3:
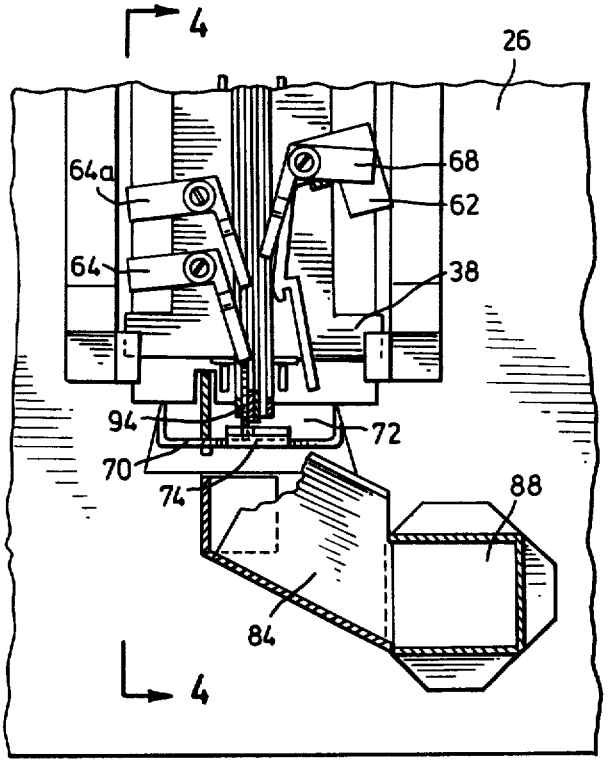
FIG. 3 is a partially cut-away view taken substantially along the arrows 3—3 of FIG. 2.
Figure 4:
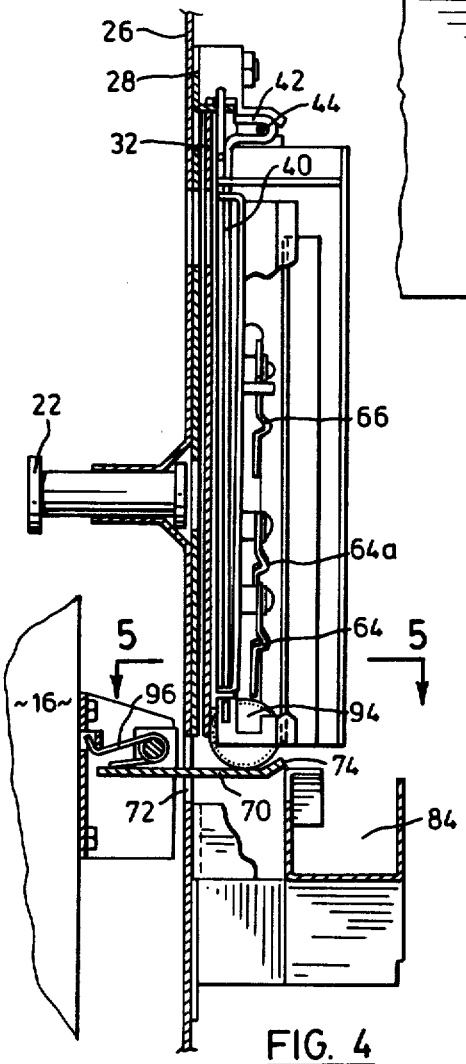
FIG. 4 is a partially cut-away section taken substantially along the arrows 4—4 of FIG. 3, but extended to include the upper portion of the coin chute mechanism.

Referring to FIGS. 3 and 4, a coin 94 is shown resting above the latch plate 70 at the bottom end of the left coin chute, when viewed from behind. The other components are shown, in their rest position—i.e., in a position when the only thing that has happened is that the coin 94 has been inserted into the appropriate slot 20 and has fallen to the bottom of the respective coin chute. Obviously, as it fell, the coin 94 brushed past the lower leg portions of the pawls 64 and 64A, each of which is shown in its position extending into the coin chute, due to the overbalancing of the wing portion thereof and the fact that each pawl is loosely mounted on its respective mounting pin. As can be seen, the latch plate 70 extends beneath the bottom of the coin chute, so as to support any coins which are within either of the coin chutes, as discussed hereafter. It will also be noted, in FIG. 4, that the latch plate 70 is spring biased in its upper position, as shown, by spring 96. Moreover, as previously stated, the latch plate 70 is mounted to the upper portion 16 of the door 12.

Turning now to FIGS. 5, 6 and 7, a description follows as to the coin return operation and mechanism of coin operated vending mechanisms according to the present invention. As noted in FIG. 5, a coin 94 is in place, in the same manner as in FIG.4, and the coin return button 22 is unpressed—i.e. it, too, is in the same position as in FIG. 4. As previously stated, the coin chutes are defined between the webs 56 and the coin chute cover plates 58.

If it is desired by the operator (customer) to have his coin returned, the coin return button 22 is pressed inwards, as at arrow 98 in FIG. 6. This causes the front plate 32 to pivot or hinge inwardly, as shown, about its mounting position on tangs 34, carrying with it the associated components mounted upon it. As the front plate 32 pivots backwardly, shown at arrows 100 in FIGS. 6 and 7, the latch plate 70 is forced downwardly as indicated in dotted lines in FIG. 6, and then due to the bias of spring 96, it swings upwardly to its rest position, this operation being shown by arrow 102 in FIG. 6. As will be shown hereafter, the rearward motion of the coin return button 22, and the upsetting action which it causes on the latch plate 70, must be quite rapid, otherwise a blocking arrangement of the anti-theft plate 78 and counter-balance plate 80 will preclude rearward motion of the coin chutes, and thereby preclude a coin return operation. As will be noted, this is so that the main latch plate 70 does not remain in an open or unlatched position, with respect to the latch hook to which it latches, other than momentarily.

Assuming that the coin chute mechanism has been permitted to swing backwardly far enough to clear the counter balance plate 80 as discussed hereafter, and referring specifically to the embodiment of FIGS. 1 through 7 at this point, upon further rearward motion of the front plate 32, the lower wing extensions 104 of the pawl mounting plate 38 strike tabs 106, and are upset by them so as to open the coin chute cover plates 58 in the manner shown at arrows 108 in FIG. 7. As there in now nothing beneath the coin chute to retain the coin in place, it falls from the chute into the coin return chute 84, as shown in FIG. 6.

Figure 8:
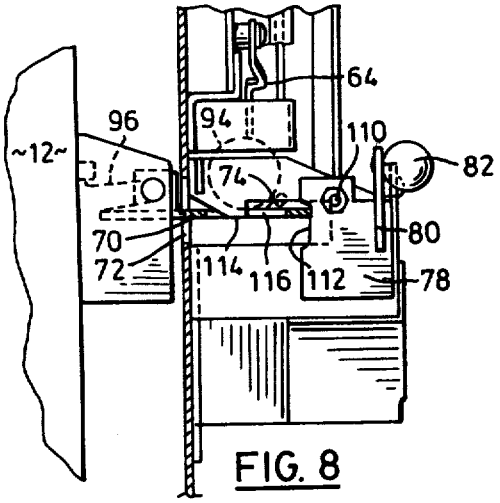
FIG. 8 is a partially cut-away section taken in the direction of arrows 8—8 in FIG. 2.
Figure 9:
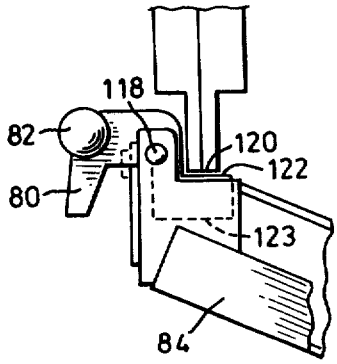
FIG. 9 is a rear elevation showing a detail of FIG. 8.

With reference now to FIGS. 8 and 9, the initial operation of the anti-theft mechanism is discussed. As noted, the anti-theft plate 78 is mounted for rotation about a mounting point or pin 110. The anti-theft plate is dimensioned—and, in the present embodiment, notched as at 112—so as to engage the rear end of the latch plate 70. As stated, in its normal position, the latch plate 70 is such as to co-operate with latch hook 114, so as to preclude forward movement of the door by more than a short amount represented by the opening 116 in the latch plate, into which the latch hook 114 extends. Thus, except when the latch plate 70 is cammed downwardly so as to clear the interference of the latch hook 114 with the rear end of latch opening 116 in the latch hook, the door cannot be unlatched.

As noted in FIGS. 8 and 9, the counter-balance plate 80 is mounted for rotation about a mounting point or pin 118. As noted in FIGS. 2 and 9, the lower point 120 of the coin chute structure is such that it is above edge 122 of the lower leaf portion 123 of the counter-balance plate 80. Clearly, then, in order for the coin chute assembly to move far enough rearwardly so that the coins in the coin chute clear contact with the latch plate 70 and may then fall into the coin return chute 84, the coin chute assembly must move rearwardly sufficiently quickly that the lower point 120 of the coin chute assembly clears the edge 122 of the leaf portion 123 before the counter-balance plate 80 can fall into place due to gravity acting upon the weight 82. This is shown more clearly in FIG. 11, where the counter-balance plate 80 is shown to have rotated in the manner shown by arrows 124, so as to cause an interference of the lower leaf portion 123 of the plate 80 with the lower end 120 of the coin chute assembly. See also FIG. 10.

Figure 10:
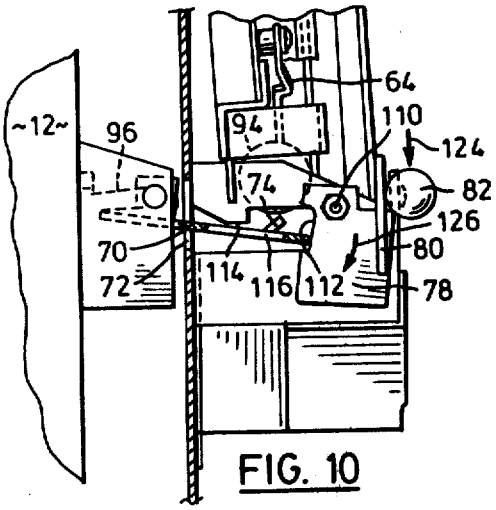
FIG. 10 is a view similar to FIG. 8 showing the components in a somewhat different operating position.
Figure 11:
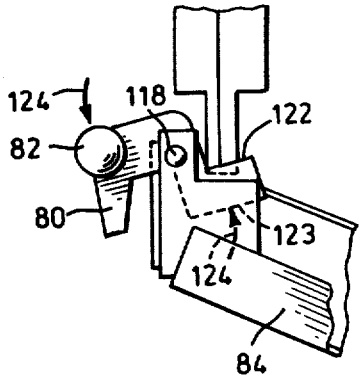
FIG. 11 is a view similar to FIG. 9, being a rear view of FIG. 10.

When the door 12, and thus the latch plate 70, is moved forwardly to any extent, the anti-theft plate 78 is permitted to swing downwardly as indicated at arrow 126 in FIG. 10, and the counter-balance plate 80 is permitted to swing as indicated by arrow 124 in FIGS. 10 and 11. This, then, creates a blocking action against rearward motion of the coin chute mechanism, as clearly shown in FIGS. 10 and 11. As previously discussed, in order for the coin chute mechanism to move rearwardly as indicated in FIG. 6, the coin return button 22 must be depressed quickly; and moreover, the door 12 cannot be swung forwardly, because to do so creates a blocking action of the anti-theft mechanism described above. A positive acting, simply constructed, anti-theft mechanism is thereby provided.

Figure 12:
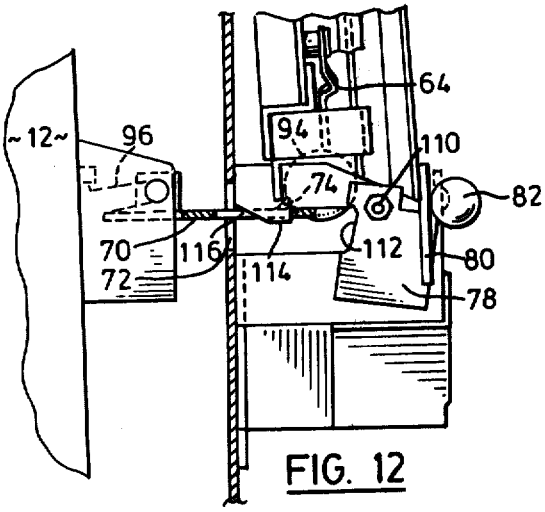
FIG. 12 is a view similar to FIG. 10, showing the door and latch in yet a further position.

Referring, then, to FIGS. 10 and 12, a normal vending operation is clearly indicated, whereby the coin 94 acts against the coin camming portion 74 of the latch plate 70, retaining the latch plate 70 below a position where the rear end of slot 116 interferes with the latch hook 114, and thereby permitting forward movement of the door 12 and the latch plate 70. This is caused by interference between the edge of the coin 94 and the pawl 64, such that the pawl pushes down against the coin, which pushes against the spring bias of spring 96 against latch plate 70, causing latch plate 70 to tilt downwardly as indicated in FIG. 10 so as to clear the latch hook 114.

Figure 13:
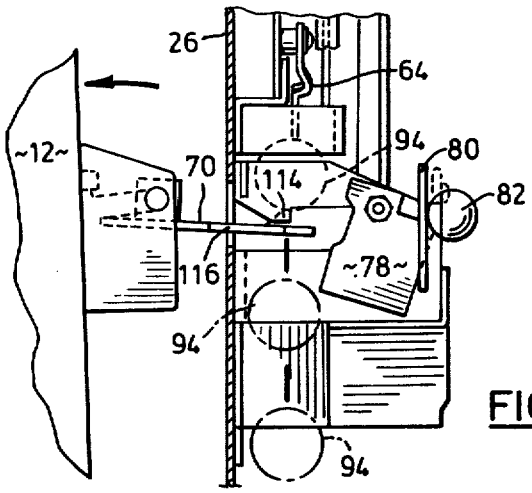
FIG. 13 is a view similar to FIG. 8, showing the door and latch components in a position similar to that of FIG. 12.

Referring, now, to FIG. 13, the final operation is noted, whereby the coin 94 falls past the position normally occupied by the latch plate 70 as it swings clear of engagement with the latch hook 114, thereby permitting the customer to have access to the interior of the cabinet 10 to retrieve therefrom a newspaper or other article being vended; as well as retention within the coin vending mechanism of the coin or coins by which the operation was successfully completed.

With reference to the operation of the pawls, the specific arrangement illustrated in FIG. 2 is such that for a weekday operation, the coin operated vending mechanism can be operated by insertion of twenty five cents, being one quarter (twenty five cent piece) or three dimes (ten cent pieces) with no change. This is accomplished by either the pawl 64 or the pawl A weekend operation is, as noted above, set into place by rotation of the key cylinder 50, whereby pawls 66 and 62 are unlocked. This is then set up for a forty cent operation, which may be one quarter, one nickel and one dime, one quarter and three nickels, or two quarters (no change). The exact spacing and placement of the pawls 64 and **64*a* is such that pawl 64 will not operate with one quarter beneath it, but pawl 64*a* will operate with two quarters beneath it, one of which shoves aside the lower end of pawl 64 making it inoperative. Also, pawl 64a** will not operate with one quarter and one nickel, which are nearly the same in size but sufficiently different that ordinary manufacturing tolerances are acceptable in the assembly of the coin operated vending mechanism according to this invention.

The combination pawl 62 is such that, if only a quarter and a nickel are in the left hand coin chute (as viewed from behind), and a vending operation is attempted to be initiated, the top most coin rises upwardly into slot 128, and fails to depress the latch plate 70. However, when a dime is in place in the right hand coin chute, the bottom end of the combination pawl 62 is swung out of place to the right, so that the point 130 interferes with the edge of the top most quarter or nickel in the left hand chute, whereby a camming of the coins against the latch plate 70 may occur, permitting the latch plate 70 to be withdrawn and the door opened, so that all of the coins including the dime in the right hand coin chute fall into the coin receptacle within the coin operating vending mechanism. Complicated cross-over and lock-out pawls, such as those used in prior known devices, are thereby eliminated.

Finally, having regard to FIGS. 14 and 15, they are equivalent to FIGS. 5 and 7, except—having regard to FIG. 2—a somewhat different arrangement is shown whereby the biasing springs by which the front plate 32 is biased towards cover plate 26, and the coin chute cover plates 58 are biased into their closed position, using the same springs 138.

As seen in FIG. 2, the front plate 32 is biased towards the cover plate 26 by springs 132. The upsetting of the coin chute cover plates away from the webs 56 is indicated in FIG. 7, by interference of the tab 104 with wing 106.

In the embodiment of FIGS. 14 and 15, a tab 134 is secured to each pawl mounting plate 38, and a pair of wings 136 is placed so as to bear against the tabs 134. However, when, as indicated in FIG. 15, the coin return button 22 is depressed, the outer ends of the pawl mounting plates 38 interfere with the inner surfaces of the wings 136, thus upsetting the coin chute cover plates 58 against the spring tension of springs 138. Indeed, springs 138 are essentially the same as springs 132, the difference being in the construction of the lower portion for interference with wings 136, as discussed immediately above. Only two springs, of reasonable weight and tension are used, as opposed to as many as five springs, including heavy compression springs, of the prior known devices.

The above discussion and description has been in respect of a preferred embodiment of coin operated vending mechanism according to the present invention, with a specific second embodiment being shown in respect of a more simplified structure. There has been some discussion of the operating mechanism, particularly as to values of coinage used, and clearly those matters are a question of design and placement of the pawls, having in mind the specific sizes of coins or tokens (in security installations) to be used. Some emphasis has been made as to the anti-theft mechanism, particularly the fact that if a coin return is to be effected, the coin chute assembly must be swung rearwardly over the coin return chute sufficiently quickly as to preclude interference of the counter-balance plate with the coin chute mechanism. This also, of course, affords a security latching system when only a token of the correct size can be used to gain access to a restricted area; and only one access operation per token is, of course, possible.

Finally, the simplicity of the design, with fewer operating parts and more easy accessibility for purposes of service and adjustment, when compared with prior known devices, have been clearly emphasized. It follows that a more simple operation, not only in warm weather, but especially also in cold weather, when the parts may be likely to become stuck to each other because of cold and stiff oil film on them, or by freezing.

No specifics as to component design or size are intended or meant, either in the above description or the accompanying drawings, except as falls within the spirit and scope of the appended claims.

I claim:

1. A coin operated vending mechanism for opening an access door to a cabinet for purposes of retrieving an object being stored therein, comprising:

a first plate having at least one slot therein to receive a coin inserted therethrough;

at least one coin chute in communication with said slot;

at least one pawl adopted to engage an edge of said coin when in place in said coin chute;

a latch plate spring biased into co-operating position with a latch hook, and having a camming portion thereof operable by co-action between proper coinage in said at least one coin chute and said at least one pawl when it is arranged in the proper position to engage said proper coinage, so as to release said latch plate from said latch hook;

said latch plate being mounted to said door so as to thereby permit opening thereof; whereby said at least one coin falls past the position normally occupied by said latch plate into a coin collecting receptacle;

a coin return button co-operating with said at least one coin chute to move said chute into a coin return position over a coin return chute;

and an anti-theft mechanism to prevent return of said at least one coin in said coin chute at the same time as said door is opened, or vice versa, comprising a first anti-theft plate adapted for rotation about a mounting point therefor, and engaging said latch plate so as to be in a first position, such that when said latch plate is moved out of engagement with said anti-theft plate said anti-theft plate swings by gravity to a second position;

and a counter-balance plate adapted for rotation about a mounting point therefor, and engaging said anti-theft plate so as to be in a first position when said anti-theft plate is in its respective first position, such that when said anti-theft plate assumes its respective second position said counter-balance plate is permitted to swing by gravity to its second position;

said second position of said counter-balance plate being such that it physically precludes movement of said at least one coin chute over said coin return chute.

2. The mechanism of claim 1, where two coin chutes are provided, each in communication with a respective slot in said first plate.

3. The mechanism of claim 2 where said first plate is a cover plate for said mechanism, and each said coin chute is defined by a web upstanding from a front plate hingedly mounted near its top for hingeable movement with respect to said cover plate, and a coin chute cover plate hingedly mounted at its front for hingeable movement with respect to said web; each said coin chute cover plate being spring biased to a first position so as to be substantially parallel to said web, and said front plate being spring biased to its respective first position so as to be substantially parallel to said cover plate.

4. The mechanism of claim 3, where the means for said spring biasing of said coin chute cover plates and said front plate comprises different springs for each.

5. The mechanism of claim 3, where the means for said spring biasing of said coin chute cover plates and said front plate comprises the same springs.

6. The mechanism of claim 1, having more than one pawl mounted to a pawl mounting plate which is moveable vertically from a first to a second position, and stop means to preclude entry of any of said pawls into said at least one coin chute in either of said first or second position of said pawl mounting plate, so that said mechanism may be set for dispening operation on two different coinage values, according to whether said pawl mounting plate is in its first or its second position.

* * * * *